US010815552B2

(12) United States Patent
Parson et al.

(10) Patent No.: US 10,815,552 B2
(45) Date of Patent: Oct. 27, 2020

(54) ALUMINUM ALLOY COMPOSITION WITH IMPROVED ELEVATED TEMPERATURE MECHANICAL PROPERTIES

(71) Applicant: Rio Tinto Alcan International Limited, Montreal (CA)

(72) Inventors: Nicholas C. Parson, Kingston (CA); Pierre Marchand, Longueuil (CA); Jean-Alain Laurin, Chicoutimi (CA)

(73) Assignee: Rio Tinto Alcan International Limited, Montreal (CA)

( * ) Notice: Subject to any disclaimer, the term of this patent is extended or adjusted under 35 U.S.C. 154(b) by 640 days.

(21) Appl. No.: 14/309,216

(22) Filed: Jun. 19, 2014

(65) Prior Publication Data

US 2014/0377128 A1 Dec. 25, 2014

Related U.S. Application Data

(60) Provisional application No. 61/972,767, filed on Mar. 31, 2014, provisional application No. 61/836,953, filed on Jun. 19, 2013.

(51) Int. Cl.
*C22C 32/00* (2006.01)
*C22C 21/08* (2006.01)
(Continued)

(52) U.S. Cl.
CPC ..... *C22C 32/0057* (2013.01); *B22D 15/00* (2013.01); *B22D 19/14* (2013.01);
(Continued)

(58) Field of Classification Search
CPC ..... C22C 21/08; C22C 32/0057; C22C 49/06; B22D 19/14
See application file for complete search history.

(56) References Cited

U.S. PATENT DOCUMENTS 3,356,618 A 12/1967 Rich et al.
4,759,995 A 7/1988 Skibo et al.
(Continued)

FOREIGN PATENT DOCUMENTS

CA 2259448 A1 1/1998
CA 2357323 A1 3/2002
(Continued)

OTHER PUBLICATIONS

Davis, J.R. ASM Specialty Handbook: "Aluminum and Aluminum Alloys", 1993, p. 23.*
(Continued)

*Primary Examiner* — George Wyszomierski
*Assistant Examiner* — Janell C Morillo
(74) *Attorney, Agent, or Firm* — Banner & Witcoff, Ltd.

(57) ABSTRACT

An aluminum alloy includes, in weight percent, 0.50-1.30% Si, 0.2-0.60% Fe, 0.15% max Cu, 0.5-0.90% Mn, 0.6-1.0% Mg, and 0.20% max Cr, the balance being aluminum and unavoidable impurities. The alloy may include excess Mg over the amount that can be occupied by Mg—Si precipitates. The alloy may be utilized as a matrix material for a composite that includes a filler material dispersed in the matrix material. One such composite may include boron carbide as a filler material, and the resultant composite may be used for neutron shielding applications.

11 Claims, 5 Drawing Sheets

(51) Int. Cl.

| | |
|---|---|
| ***B22D 19/14*** | (2006.01) |
| ***C22C 49/06*** | (2006.01) |
| ***B22D 21/00*** | (2006.01) |
| ***C22F 1/05*** | (2006.01) |
| ***C22F 1/047*** | (2006.01) |
| ***C22C 1/06*** | (2006.01) |
| ***C22C 1/02*** | (2006.01) |
| ***C22F 1/043*** | (2006.01) |
| ***B22D 25/06*** | (2006.01) |
| ***C22C 21/02*** | (2006.01) |
| ***C22C 47/08*** | (2006.01) |
| ***C22C 49/14*** | (2006.01) |
| ***B22D 15/00*** | (2006.01) |
| ***C22C 1/10*** | (2006.01) |

(52) U.S. Cl.

CPC ..... *B22D 21/007* (2013.01); *B22D 25/06* (2013.01); *C22C 1/026* (2013.01); *C22C 1/06* (2013.01); *C22C 1/1036* (2013.01); *C22C 21/02* (2013.01); *C22C 21/08* (2013.01); *C22C 32/0005* (2013.01); *C22C 47/08* (2013.01); *C22C 49/06* (2013.01); *C22C 49/14* (2013.01); *C22F 1/043* (2013.01); *C22F 1/047* (2013.01); *C22F 1/05* (2013.01)

(56) References Cited

U.S. PATENT DOCUMENTS

| | | | |
|---|---|---|---|
| 4,786,467 | A | 11/1988 | Skibo et al. |
| 4,806,307 | A | 2/1989 | Hirose et al. |
| 4,828,008 | A | 5/1989 | White et al. |
| 5,076,340 | A | 12/1991 | Bruski et al. |
| 5,083,602 | A | 1/1992 | Skibo |
| 5,186,234 | A | 2/1993 | Hammond et al. |
| 5,246,057 | A | 9/1993 | Hansson et al. |
| 5,394,928 | A | 3/1995 | Hammond et al. |
| 5,395,701 | A | 3/1995 | White et al. |
| 5,415,708 | A | 5/1995 | Young et al. |
| 5,521,016 | A | 5/1996 | Pyzik et al. |
| 5,700,962 | A | 12/1997 | Carden |
| 5,858,460 | A | 1/1999 | Ferrando et al. |
| 5,965,829 | A | 10/1999 | Haynes et al. |
| 6,602,314 | B1 | 8/2003 | Sakaguchi et al. |
| 7,125,515 | B2 | 10/2006 | Aruga et al. |
| 7,562,692 | B2 | 7/2009 | Fortin et al. |
| 7,572,521 | B2 | 8/2009 | Mergen et al. |
| 2002/0021779 | A1 | 2/2002 | Murakami et al. |
| 2002/0084006 | A1 | 7/2002 | Chu et al. |
| 2003/0179846 | A1 | 9/2003 | Murakami et al. |
| 2006/0090872 | A1 | 5/2006 | Fortin et al. |
| 2009/0127271 | A1 | 5/2009 | Muraoka |
| 2012/0325381 | A1 | 12/2012 | Gasqueres et al. |

FOREIGN PATENT DOCUMENTS

| | | | | |
|---|---|---|---|---|
| CN | 708597 | A | | 12/2005 |
| DE | 19905702 | C1 | | 5/2000 |
| EP | 211779 | A1 | | 2/1987 |
| EP | 258178 | A1 | | 3/1988 |
| EP | 0608299 | A1 | | 8/1994 |
| EP | 1956107 | A1 | † | 8/2008 |
| GB | 2361934 | A | | 11/2001 |
| JP | 61235523 | | | 10/1986 |
| JP | H0734170 | A | | 2/1995 |
| JP | 2002022880 | A | | 1/2002 |
| JP | 2002-115019 | A | | 4/2002 |
| JP | 2006316321 | A | * | 11/2006 |
| JP | 2007040914 | A | | 2/2007 |
| JP | 2007-218639 | A | | 8/2007 |
| JP | 2009-526913 | A | | 7/2009 |
| JP | 4333542 | B2 | | 9/2009 |
| JP | 4674160 | B2 | | 4/2011 |
| JP | 2013-517383 | A | | 5/2013 |
| RU | 1838441 | C | | 8/1993 |
| RU | 2296804 | C1 | | 4/2007 |
| WO | 0026921 | A2 | | 5/2000 |
| WO | 2004/038050 | A2 | † | 5/2004 |
| WO | 2004038050 | A2 | | 5/2004 |
| WO | 2005103312 | A1 | | 11/2005 |
| WO | 2007094686 | A1 | | 8/2007 |
| WO | 2007111325 | A1 | | 10/2007 |
| WO | 2011122958 | A1 | | 10/2011 |
| WO | 2013133976 | A1 | | 9/2013 |
| WO | 2013133978 | A1 | | 9/2013 |

OTHER PUBLICATIONS

Brown, Inerrante, Abramson: "Neutron Absorbers: Qualification and Acceptance Tests", International Symposium on Packaging and Transportation of Radioactive Materials (PATRAM), Sep. 2001, published by U.S. Nuclear Regulatory Commission.

Lucas, Stephens, Greulich: "The Effect of Reinforcement Stability on Composition Redistribution in Cast Aluminum Metal Matrix Composites", Materials Science and Engineering, No. A131 (1991), pp. 221-230, XP002270490 USA.

Kennedy, Brampton: "The Reactive Wetting and Incorporation of BAC Particles into Molten Aluminium", SCRIPTA Materialia, No. 44 (2001), pp. 1077-1082, XP002270491 UK.

Chernyshova, Rebrov: "Interaction Kinetics of Boron Carbide and Silicon Carbide with Liquid Aluminium", Journal of the Less Common Metals, No. 117 (1986), pp. 203-207, XP002270492 Russia.

Sep. 24, 2014—(WO) International Search Report and Written Opinion—App. PCT/CA2014/050576.

Suarez, C.E., "Light Metals 2012", John Wiley & Sons, May 11, 2012 (Nov. 5, 2012), p. 456.

Meric, C. et al., "Effect of Aging on Abrasive Wear of Deformable Aluminun Alloy AA6351", Metal Sicence and Heat Treatment, No. 3, pp. 18-22, Mar. 2004.

Oct. 12, 2016—(CN) Office Action—App 2014800317147—English Translation.

Jan. 23, 2017—(EP) Third Party Observation—App 14813162.6.

Apr. 28, 2018—(RU) Office Action—App 2016101213/02—Eng Tran.

Apr. 4, 2018—(RU) Search Report—App 2016101213—Eng Tran.

Jul. 25, 2018—JP Office Action—App 2016-520206—Eng Tran.

Jun. 26, 2017—(JP) Provision of Information from foreign application , JP 2016-520206 A.

Jun. 19, 2019—(CA) Office Action—App 2,912,021.

Dec. 3, 2019—(JP) Office Action—App 2019-011731—Eng tran.

Lai et al. "Effect of Sc, Zr, and Ti on the interfacial reactions of the B4C/A1 systems", J. Mater. Sci., 2011, vol. 46, Issue 2, pp. 451-459.

* cited by examiner
† cited by third party

ALUMINUM ALLOY COMPOSITION WITH IMPROVED ELEVATED TEMPERATURE MECHANICAL PROPERTIES

CROSS-REFERENCE TO RELATED APPLICATIONS

This application claims priority to and the benefit of U.S. Provisional Application No. 61/836,953, filed Jun. 19, 2013, and U.S. Provisional Application No. 61/972,767, filed Mar. 31, 2014, which applications are incorporated by reference herein and made part hereof.

FIELD OF THE INVENTION

The present invention relates generally to an aluminum alloy having improved mechanical properties at elevated temperatures, as well as $B_4C$ composite materials and other composite materials utilizing the aluminum alloy as a matrix.

BACKGROUND

Aluminum matrix composites reinforced with $B_4C$ particulate are widely used for neutron capture during storage of spent nuclear fuel. In this usage, the $^{10}B$ isotope content of the $B_4C$ particulate provides neutron absorption capabilities necessary for safe fuel storage, while the aluminum matrix provides strength and allows the material to be readily formed into useful shapes by conventional metal forming techniques, such as rolling or extrusion. Extruded profiles are used in current dry storage systems, and 6XXX series type alloys have been found to be suitable matrix materials providing compatibility with a liquid metal production route for the composite along with the extrusion process. Additionally, the metallurgy of the 6XXX alloy family allows the solution heat treatment step to be conducted during extrusion, allowing a process step to be removed. Further, at room temperature the 6XXX alloy series can provide useful tensile properties of up to ~300 MPa YS and 350 MPa UTS due to the nano-sized β' Mg—Si precipitate structure developed during heat treatment.

Service temperatures in dry storage of spent nuclear fuel can approach up to 250° C., and expected service times may be 40 years and more. As with most metallic materials, aluminium can soften at elevated temperature, due to increased dislocation mobility. However, for the Al—Mg—Si precipitation hardening system, a further and more dramatic loss in mechanical properties can occur above ~150° C., due to coarsening and dissolution of the precipitates of the age hardened microstructure. Such loss of mechanical properties may cause failure in the stability and/or integrity of containers manufactured using such alloys, when utilized at elevated temperatures for extended periods of time.

The present invention is provided to address at least some of these problems and other problems, and to provide advantages and aspects not provided by prior alloys, composites, and processing methods. A full discussion of the features and advantages of the present invention is deferred to the following detailed description.

SUMMARY OF THE INVENTION

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to an aluminum alloy composition containing, in weight percent:

| | |
|---|---|
| Si | 0.50-1.30 |
| Fe | 0.2-0.60 |
| Cu | 0.15 max |
| Mn | 0.5-0.90 |
| Mg | 0.6-1.0 |
| Cr | 0.20 max |

the balance being aluminum and unavoidable impurities. The unavoidable impurities may be present in an amount of up to 0.05 wt. % each and up to 0.15 wt. % total, in one embodiment. According to some aspects, the alloy may be considered to be a 6XXX alloy.

According to one aspect, the aluminum alloy composition may have a copper content of 0.1 max wt. %, a silicon content of 0.70-1.30 wt. %, and/or a magnesium content of 0.60-0.80 wt. %.

According to another aspect, the aluminum alloy composition may further include titanium. In one embodiment, the alloy may include up to 0.05 wt. % titanium. In another embodiment, the alloy may include at least 0.2 wt. % titanium, or 0.2-2 wt. % titanium.

According to a further aspect, the alloy may include excess magnesium over the amount that can be occupied by Mg—Si precipitates. This excess magnesium is shown to produce increased high temperature mechanical properties. The alloy may include at least 0.25 wt. % excess magnesium in one embodiment.

Additional aspects of the disclosure include a composite material that has a matrix of an aluminum alloy as described herein and particles of a filler material dispersed within the matrix. According to one aspect, the filler material includes boron carbide (e.g., $B_4C$) and/or other ceramic material. The filler material may additionally or alternately contain other materials, according to other aspects.

According to one aspect, where the filler material includes boron carbide, the filler material includes a titanium-containing intermetallic compound coating at least a portion of the surface thereof.

According to another aspect, the filler material has a volume fraction of up to 20% in the composite material.

According to a further aspect, the filler material has a higher hardness and a higher melting point than the aluminum alloy of the matrix.

Further aspects of the disclosure relate to a method of manufacturing a composite material using the alloy as described herein as a matrix material. The method generally includes preparing or providing a molten aluminum alloy as described herein, adding particles of a filler material to the molten aluminum alloy to form a molten mixture having the filler material dispersed throughout the alloy, and casting the molten mixture to form the composite material having the aluminum alloy as a matrix material and the filler material dispersed throughout the matrix. The cast composite material may further be extruded to form an extruded product.

According to one aspect, the filler material may be or include boron carbide particles. In such a method, the molten alloy may further include at least 0.2 wt. % or 0.2-2 wt. % titanium.

During casting of this material, a titanium-containing intermetallic compound forms to coat at least a portion of the surface of the particles of the filler material.

According to another aspect, the filler material forms up to 20% volume fraction of the molten mixture, and also forms up to 20% of the volume fraction of the resultant composite material.

According to a further aspect, the method further includes stirring the molten mixture to wet the aluminum alloy to the particles of the filler material and to distribute the particles throughout the volume of the molten mixture, prior to casting.

Still further aspects of the disclosure relate to extruded products that are formed from an aluminum alloy or a composite material as described herein. Prior to extrusion, the alloy or composite material may be formed by casting according to a method as described herein.

Other features and advantages of the invention will be apparent from the following description.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
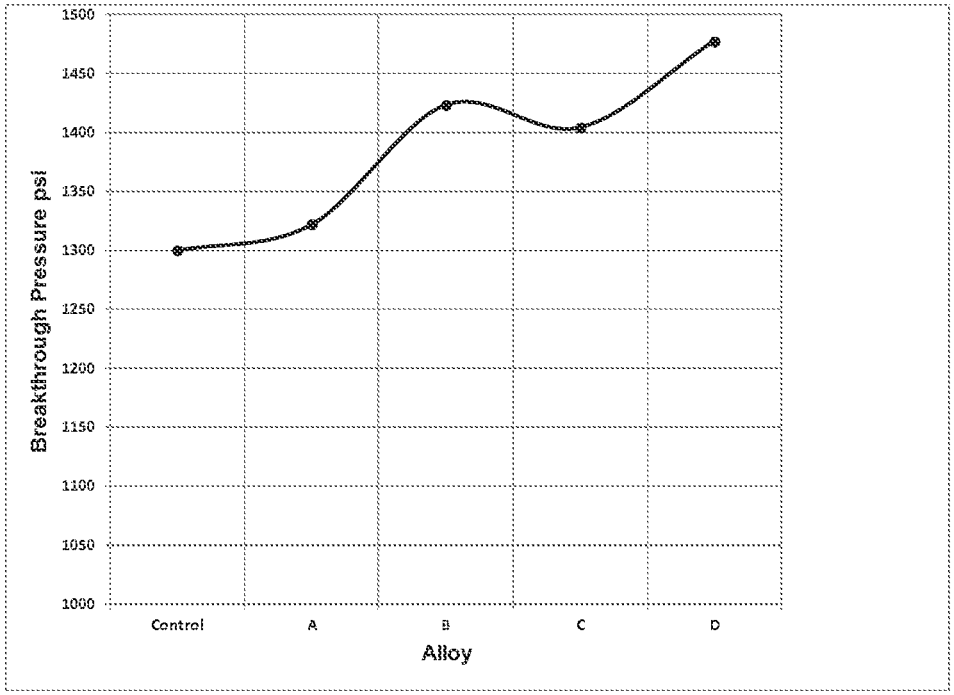
FIG. 1 is a graphical illustration of breakthrough pressure of various alloys tested in connection with the Example below.
Figure 2:
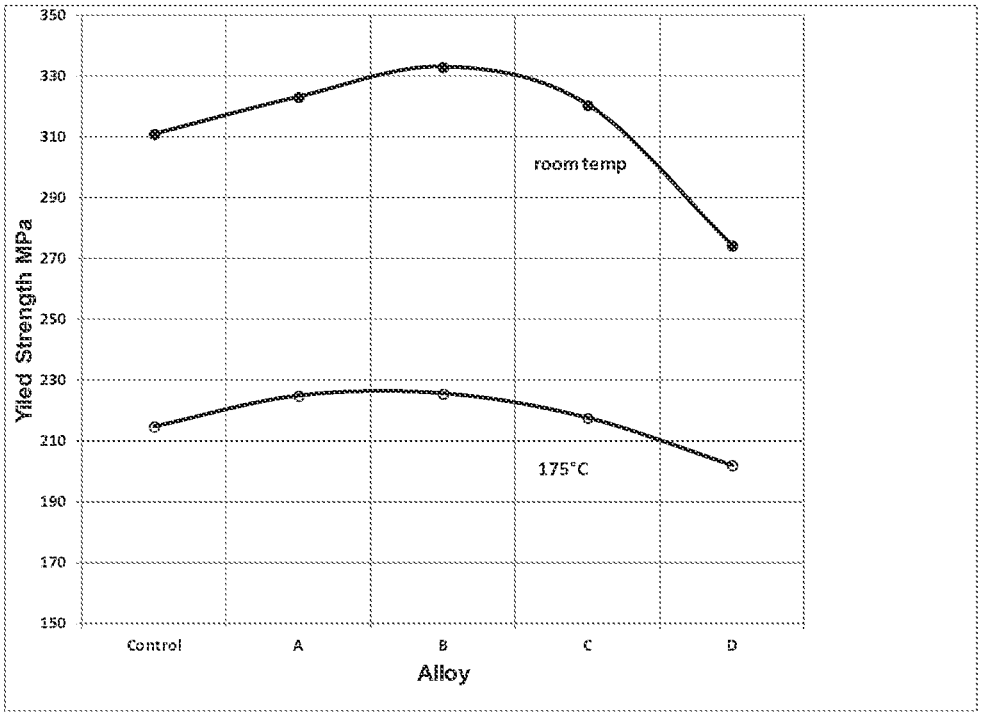
FIG. 2 is a graphical illustration of yield strengths of various alloys tested at room temperature and 175° C., in connection with the Example below.
Figure 3:
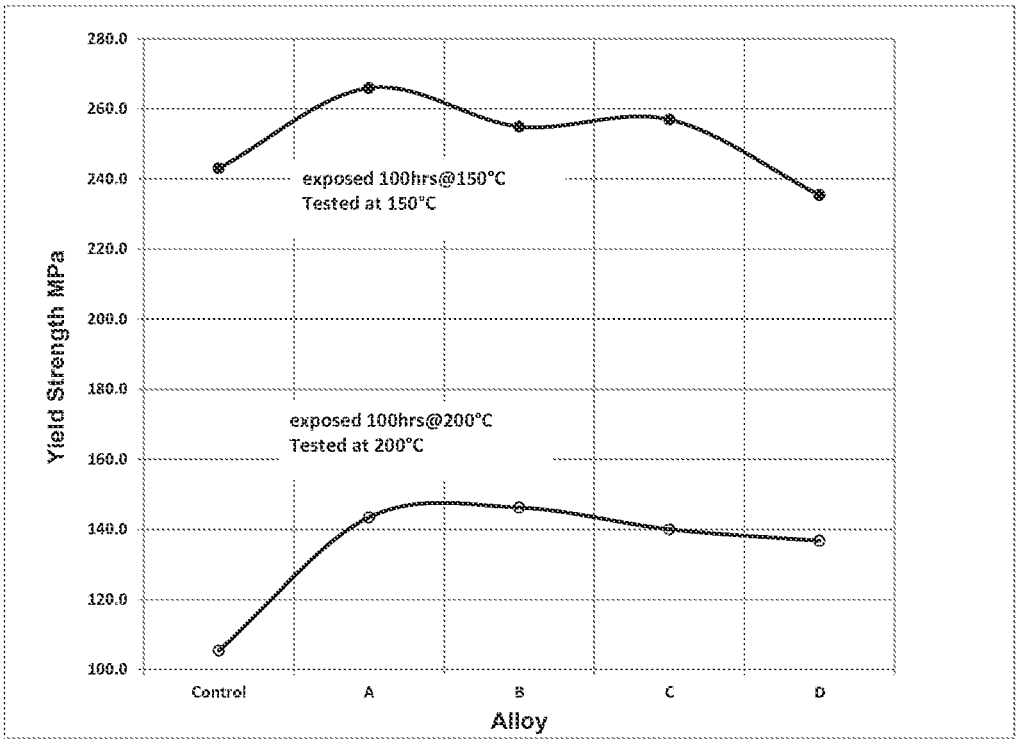
FIG. 3 is a graphical illustration of yield strength of various alloys tested at 150° C. and 200° C., in connection with the Example below.
Figure 4:
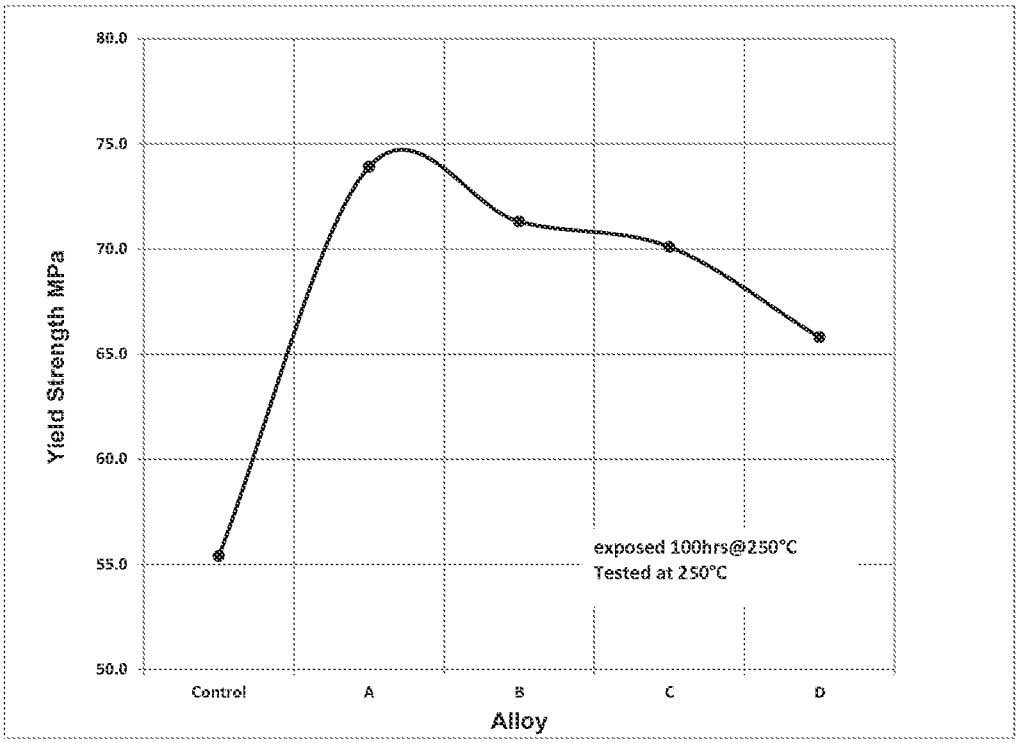
FIG. 4 is a graphical illustration of yield strength of various alloys tested at 250° C., in connection with the Example below.

In general, alloy compositions are provided that exhibit increased mechanical properties at elevated temperatures relative to other alloys, such as at least 150° C. or at least 250° C., including increased mechanical properties when exposed to such elevated temperatures for an extended period of time (e.g., 40 years). In one embodiment, the alloy may provide increased mechanical properties for exposure of up to 350° C. for extended periods of time. Alloy compositions according to embodiments described herein may be utilized in various applications, including applications where high-temperature strength and/or extrudability is desirable. In one example, the alloy may be used as a matrix for boron carbide composite materials and other composite materials.

According to one embodiment, the aluminum alloy composition contains, in weight percent:

| | |
|---|---|
| Si | 0.50-1.30 |
| Fe | 0.2-0.60 |
| Cu | 0.15 max |
| Mn | 0.5-0.90 |
| Mg | 0.6-1.0 |
| Cr | 0.20 max |

the balance being aluminum and unavoidable impurities. The balance of the alloy includes aluminum and unavoidable impurities. The unavoidable impurities may each be present at a maximum weight percent of 0.05, and the maximum total weight percent of the unavoidable impurities may be 0.15, in one embodiment. The alloy may include further alloying additions in another embodiment.

In one embodiment, the alloy contains 0.50-1.30 wt. % silicon. In another embodiment, the alloy contains 0.70-1.30 wt. % silicon. Silicon additions can increase the strength of the alloy, such as by precipitation hardening in forming Mg—Si precipitates. Silicon can also combine with other additions, such as iron and manganese, to form intermetallic phases. Silicon is not present in excess in one embodiment, with "excess" silicon being defined based on the amount of silicon that can form Mg—Si precipitates (using a 1/1 atomic Mg/Si ratio) in addition to the amount of silicon that can combine with Fe and Mn in intermetallic phases. The amount of Si combined with the Mn and Fe containing intermetallic phases is somewhat imprecise but can be approximated by (Mn+Fe+Cr)/3. The following equation can be used for determining excess silicon using these factors:

$$\text{Excess Si} = \text{Si} - 1.16\text{Mg} - (\text{Mn}+\text{Fe}+\text{Cr})/3 \text{ (all values in wt \%)}$$

When the amount of silicon is greater than dictated by the above equation, the alloy is considered to contain excess silicon. In one embodiment, the alloy may include excess magnesium, as described below. In a further embodiment, the alloy may contain a balanced amount of silicon and magnesium, or in other words, may not contain excess silicon or magnesium.

In one embodiment, the alloy contains 0.60 to 1.0 wt. % magnesium, and the alloy may contain 0.60 to 0.80 wt. % magnesium in another embodiment. As mentioned above, in one embodiment, the alloy may contain at least some excess magnesium (i.e., excess Mg>0), and in another embodiment, the alloy may contain at least 0.25 wt. % excess magnesium. Excess magnesium can be determined by essentially the same equation as used above for determining excess silicon. This equation, when configured for calculation of excess magnesium, is as follows:

$$\text{Excess Mg} = \text{Mg} - (\text{Si} - (\text{Mn}+\text{Fe}+\text{Cr})/3)/1.16 \text{ (all values in wt \%)}$$

Existing alloys of this type generally do not use excess magnesium, with a target of optimizing extrudability and mechanical strength at room temperature, and typically use silicon and magnesium close to the proportion for forming the age hardening MgSi precipitates. In fact, such excess Mg additions are often considered an inefficient use of alloy additions, as ageing response is not optimized and the excess magnesium can be detrimental to extrudability. However, it is demonstrated herein that the use of excess magnesium can increase high-temperature mechanical properties while still providing adequate extrudability. In another embodiment, the amounts of silicon and magnesium may be balanced according to the above equations, as mentioned above.

In one embodiment, the alloy contains up to 0.15 max wt. % copper. The presence of copper can increase the strength of the alloy, such as by forming precipitates which contribute to precipitation hardening. In other embodiments, the alloy may contain up to 0.1 max wt. % or up to 0.10 max wt. % copper. In a further embodiment, the alloy may contain up to 0.3 max wt. % copper.

In one embodiment, the alloy contains 0.2-0.60 wt. % iron. Additionally, in one embodiment, the alloy includes 0.5-0.90 wt. % manganese. Further, in one embodiment, the alloy contains up to 0.2 max wt. % chromium.

The alloy may contain other alloying additions in further embodiments, and it is understood that the alloy may include impurities as described above. For example, in one embodiment, where the alloy is used as a matrix material for a composite containing boron carbide filler material, at least 0.2 wt. % titanium, or 0.2-2 wt. % titanium may be added to the liquid alloy to maintain fluidity during a liquid mixing operation, as described below. However, this titanium typically reacts during the liquid mixing and is therefore generally not present in the solid alloy matrix. When used as a monolithic alloy, up to 0.05 wt. % titanium may be added for use as a grain refiner.

Alloys according to embodiments described herein can provide good strength over a wide range of temperatures, and can provide increased strength relative to other alloys at high temperatures, particularly after long-term exposure to high temperatures. At room temperature, MgSi precipitation hardening is an effective mechanism for strengthening alloys as described herein, but its effect diminishes at higher temperatures, due to particle coarsening. Other strengthening mechanisms, such as dispersion strengthening and solid solution strengthening, are more thermally stable. The Mn and Fe additions in alloys according to embodiments described herein produce an increased volume fraction of stable second phase particles such as Al—Fe—Mn—Si, which provide dispersion strengthening. Additionally, alloys according to embodiments described herein contain excess Mg, which is not tied up in MgSi precipitates and instead, is in solid solution where it can provide solid solution strengthening. The dispersion strengthening and solid solution strengthening can achieve the increased high-temperature mechanical properties described herein, particularly when their effects are combined.

The alloy may be used in forming a variety of different articles, and may be initially produced as a billet. The term "billet" as used herein may refer to traditional billets, as well as ingots and other intermediate products that may be produced via a variety of techniques, including casting techniques such as continuous or semi-continuous casting and others.

Alloys according to embodiments described herein may be further processed in creating products. For example, billets of an alloy may be extruded into various profiles, which generally have a constant cross-sectional shape along their entire salable length. Extrusions of the alloy may be quenched, such as by water quenching, after extrusion. Further, extrusions or other alloy products may be artificially aged, such as by holding for 8 hrs at 175° C. Additional processing steps may be used in other embodiments, including processing steps known in the art for 6XXX alloys. It is understood that an extruded article may have a constant cross section in one embodiment, and may be further processed to change the shape or form of the article, such as by cutting, machining, connecting other components, or other techniques. Other forming techniques may additionally or alternately be used, including rolling, forging, or other working techniques.

Some of these techniques may also be used for processing composites using the alloy as a matrix. For example, a billet of such a composite may be cast from a melt, as described below. A resultant composite material may also be formed into a desired shape, such as by extrusion, rolling, forging, other working, machining, etc. The alloy embodiments, and composites produced using such alloys, are compatible with the hot extrusion process and "in press" solutionizing, which eliminates the need for a separate solutionizing step. For successful press solutionizing, the ram speed/billet temperature combination should generate sufficient temperatures inside the extrusion press to take the metal above the solvus or solution temperature. This process can be monitored by the exit temperature at the press platen, where typically a temperature of at least 510° C. is targeted. The extrusion should then be quenched by water or air at the press exit to retain the solution treated microstructure. For example, the alloy/composite may be press quenched after extrusion in such a process. In another embodiment, the alloy/composite may be subjected to a formal furnace solution treatment. The alloy, or a composite including the alloy, may also be shape-cast using a variety of different shape-casting techniques.

The embodiments of alloys described herein may be used to produce composite materials, with the alloy as the matrix material, in combination with a filler material. It is noted that the use of the term "matrix" does not imply that the alloy makes up a majority or a largest share of the weight, volume, etc., of the composite, unless otherwise specified. Instead, the matrix is the material in which the filler material is embedded and which binds the filler material together, and the matrix may be completely continuous in some embodiments. In one embodiment, the composite material contains up to 20% volume fraction of the filler material, and the matrix material forms 80% or more of the volume fraction of the composite. For example, in a composite with a boron carbide filler material, the volume fraction of the filler material may be about 4%, 7%, 10.5%, 12%, 16%, or 17.5% in various embodiments. It is understood that in one embodiment, the 20% volume fraction of the filler material mentioned above may reflect an aggregate volume fraction of multiple different filler materials, and in another embodiment, said 20% volume fraction may be a volume fraction for a single type of filler material (e.g., boron carbide), and other types of filler materials may be present.

The filler material may be any of a variety of materials, including boron carbide (e.g, $B_4C$) and/or other ceramic materials, as well as other types of materials, including other metals. The filler material may have a higher melting point and/or a greater hardness than the alloy matrix in one embodiment. Additionally, the filler material may include multiple different materials or types of materials. It is understood that a multi-component filler material may have components where some or all have higher melting points and/or greater hardness than the alloy matrix. In one embodiment, a composite may utilize an alloy as described herein as a matrix material and boron carbide as a filler material. The boron carbide in such a composite can provide neutron absorption and radiation shielding capabilities, while the alloy matrix can provide strength and allow the composite material to be formed into useful shapes by conventional metal forming techniques, such as rolling or extrusion. Other neutron absorbing and/or radiation shielding filler materials may be used in other embodiments, and it is understood that the filler material may have greater neutron absorption and radiation shielding capabilities than the matrix material, in one embodiment. A composite according to this embodiment may be utilized for storage, containment, shielding, etc., of spent nuclear fuel and other radioactive materials. For example, the composite can be used to manufacture containers, barriers, and/or other components for use in such applications. It is understood that the filler material may include boron carbide in combination with one or more other materials. In another embodiment, the filler material may include aluminum oxide ($Al_2O_3$) or aluminum oxide in combination with one or more other materials (e.g., boron carbide). In addition, boron carbide and/or other filler materials may be used in the composite material to provide other beneficial properties, such as hardness, wear resistance, strength, different friction properties, different thermal or electrical properties, etc.

Composites using the alloy as a matrix may be produced in a variety of manners. In one embodiment, the alloy may be mixed with the filler material while the alloy is in liquid form, and then the composite may be produced by various casting/molding techniques thereafter. One such technique is described in U.S. Pat. No. 7,562,692, which is incorporated herein by reference in its entirety, and which utilizes techniques for maintaining fluidity of the molten mixture, such as by having at least 0.2% by weight titanium present in the mixture, or other techniques described therein. This technique is particularly useful for composites including boron carbide filler materials. In one embodiment, the molten matrix alloy includes at least 0.2 wt. % or 0.2-2 wt. % titanium, which may be present in the alloy prior to melting or may be added to the melt itself, e.g., in the form of an Al—Ti master alloy, titanium containing granules or powders, etc. The boron carbide filler material is added to the melt, and the titanium reacts with the boron carbide to form a layer of a titanium-containing intermetallic compound, such as titanium boride (e.g., $TiB_2$), on at least part of the surfaces of the boron carbide particles. The intermetallic layer may also contain other elements, such as carbon and/or aluminum. This intermetallic compound does not disperse in the matrix and resists further reaction between the boron carbide particles and the aluminum alloy matrix. Thus, the molten composite can be held for extended periods of time without loss of fluidity caused by the gradual formation of aluminum carbides and other compounds, which helps maintain fluidity of the molten mixture. The boron carbide particles may retain this intermetallic coating after solidification of the matrix. Generally, this method may be performed by preparing a mixture of an aluminum alloy matrix as described herein, including at least 0.2 wt. % or 0.2-2 wt. % titanium, and up to 20% by volume boron carbide particles, stirring the molten mixture to wet the aluminum alloy to the boron carbide particles and to distribute the particles throughout the volume of the melt, and then casting the molten mixture.

Other methods for forming the composite may be used as well. In another embodiment, the alloy may be infiltrated into the filler material, such as by providing the filler material in porous form (e.g., particulate form, porous preform, etc.) and melting the alloy to create infiltration. In a further embodiment, powder metallurgy techniques may be used, by combining particles of the alloy with particles of the filler material (e.g., boron carbide or aluminum oxide), and then heating/sintering to form the composite. Further different techniques may be used in other embodiments. It is understood that techniques described herein for producing alloy products may also be used in producing composites utilizing such alloys, such as water quenching after extrusion, artificial aging, etc. The filler material may be provided in porous and/or particulate form for some or all of these forming embodiments.

The following example illustrates beneficial properties that can be obtained with embodiments of alloys as described herein.

EXAMPLE

The alloy compositions in Table 1 were direct chill (DC) cast as 101 mm diameter ingots and homogenised for 2 hrs/560° C., and then cooled at 350° C./hr. The homogenised ingots were cut into 200 mm billet lengths and then extruded on a 780 ton, 106 mm diameter extrusion press. The billets were induction heated to a billet temperature of 500+/−7° C. and extruded at a ram speed of 5 mm/s into a 3×41.7 mm strip. The extruded profile was water quenched using a water bath situated 2.5 m from the die. Die exit temperatures measured using a two-prong contact thermocouple were in excess of 515° C. for all extrusions. The extrusions were held at room temperature after quenching for 16 hrs and then artificially aged for 8 hrs at 175° C., which is a typical practice used with 6XXX alloys to achieve peak room temperature strength. Table 1 below illustrates all compositions tested in this Example, including the control alloy, as well as the excess silicon or magnesium contained in each alloy, calculated according to the equations above. The amount of MgSi precipitate present in the alloy and available to contribute to precipitation hardening is also shown.

TABLE 1

Alloy Compositions

| ID | Si | Fe | Cu | Mn | Mg | Ti | excess Si | excess Mg | wt % MgSi |
|---|---|---|---|---|---|---|---|---|---|
| Control | 1.05 | 0.21 | <.01 | 0.51 | 0.58 | 0.008 | 0.14 | — | 1.25 |
| A | 1.11 | 0.22 | 0.06 | 0.51 | 0.75 | 0.013 | 0.00 | 0.00 | 1.62 |
| B | 1.23 | 0.46 | 0.07 | 0.74 | 0.74 | 0.011 | — | 0.02 | 1.55 |
| C | 1.12 | 0.45 | 0.07 | 0.73 | 0.75 | 0.014 | — | 0.12 | 1.35 |
| D | 0.77 | 0.45 | 0.07 | 0.74 | 0.76 | 0.014 | — | 0.44 | 0.70 |

The alloy composition designated "Control" is a typical AA6351 or AA6082 composition used for non-particle reinforced, medium strength applications in the extrusion industry. It is designed to give a combination of good extrudability and good room temperature mechanical strength. Alloy A contains increased levels of the major solute elements that contribute towards precipitation hardening: Si, Mg and Cu. Alloy B contains increased levels of Fe and Mn, along with a slightly higher level of Si. Alloy C also contains the increased Fe and Mn levels, but with all the major solute elements at similar levels to alloy A. Finally, Alloy D contains the same elevated levels of Mn, Fe, Mg and Cu, but with a deliberately lower level of Si, which creates an increased excess Mg content. Additionally, Alloy A is balanced in terms of an Mg/Si atomic ratio of 1/1, however using an earlier approach based on $Mg_2Si$, it would have been considered heavily excess silicon. The control alloy was slightly excess in silicon but moving from alloys A through D, the compositions become progressively higher in excess Mg.

Table 2 presents breakthrough pressure for the various alloys. Breakthrough pressure is one measure of extrudability and generally represents the resistance to deformation at the extrusion temperature. The values are also expressed as % increase over the control alloy in Table 2. The same data is presented graphically in FIG. 1.

TABLE 2

| Breakthrough Pressure (units psi) | | |
|---|---|---|
| Alloy | Pmax | ΔP % |
| Control | 1300 | 0 |
| A | 1322 | 1.69 |
| B | 1423 | 9.46 |
| C | 1404 | 8 |
| D | 1477 | 13.6 |

These results indicate that compositional changes made in terms of increased Mg, Si and Cu levels, increased Fe and Mn levels, and, finally, a deliberate increase in the excess Mg content all increased the extrusion pressure. The variations in extrusion pressure listed above are acceptable for many extrusion processes, particularly extrusion into simple solid shapes with low extrusion ratios.

Room temperature mechanical properties were measured according to ISO6892-1:2009. Tensile testing at elevated temperatures was conducted according to ISO 6892-2:2011-method A, using a 10 minute preheat. Testing was conducted at room temperature and at 175° C. Additionally, samples were exposed for 100 hrs at temperatures of 150, 200, 250 and 300° C. and tested at the same temperatures in order to simulate exposure to elevated temperatures for extended periods of time.

Tables 3-5 present the yield strength, tensile strength, and elongation values measured for the various material conditions and test temperatures described above. For each condition, the strength difference as compared to the control alloy is given as a percentage (% inc). The yield strength and tensile strength results followed similar trends. The yield strength results for all six testing conditions are also presented graphically in FIGS. 2-5.

TABLE 3

| Yield Strength Results | | | | | | | | | | | | |
|---|---|---|---|---|---|---|---|---|---|---|---|---|
| | Exposure | | | | | | | | | | | |
| | None | | None | | 100 hrs | | 100 hrs | | 100 hrs | | 100 hrs | |
| | Test Temp. | | | | | | | | | | | |
| | Room Temp | | 175° C. | | 150° C. | | 200° C. | | 250° C. | | 300° C. | |
| Alloy | YS MPa | % inc | YS MPa | % inc | YS MPa | % inc | YS MPa | % inc | YS MPa | % inc | YS MPa | % inc |
| Control | 310.9 | 0 | 214.7 | 0 | 243.0 | 0 | 105.4 | 0 | 55.4 | 0 | 27.3 | 0 |
| A | 323.2 | 3.9 | 224.8 | 4.7 | 265.9 | 9 | 143.4 | 36 | 73.9 | 33 | 27.2 | 0 |
| B | 320.5 | 3.1 | 217.5 | 1.3 | 254.9 | 5 | 146.2 | 39 | 71.3 | 29 | 31.0 | 14 |
| C | 333.0 | 7.1 | 225.5 | 5.0 | 256.9 | 6 | 140.0 | 33 | 70.1 | 27 | 30.4 | 11 |
| D | 274.2 | −11.8 | 202.0 | −5.9 | 235.4 | −3 | 136.7 | 30 | 65.8 | 19 | 31.8 | 16 |

TABLE 4

| Ultimate Tensile Strength Results | | | | | | | | | | | | |
|---|---|---|---|---|---|---|---|---|---|---|---|---|
| | Exposure | | | | | | | | | | | |
| | None | | None | | 100 hrs | | 100 hrs | | 100 hrs | | 100 hrs | |
| | Test Temp. | | | | | | | | | | | |
| | Room Temp | | 175° C. | | 150° C. | | 200° C. | | 250° C. | | 300° C. | |
| Alloy | UTS MPa | % inc | UTS MPa | % inc | UTS MPa | % inc | UTS MPa | % inc | UTS MPa | % inc | UTS MPa | % inc |
| Control | 341.2 | 0 | 237.4 | 0 | 261.7 | 0 | 125.2 | 0 | 66.0 | 0 | 33.9 | 0 |
| A | 352.1 | 3.2 | 249.5 | 5.1 | 285.5 | 9 | 165.3 | 32 | 85.9 | 30 | 34.7 | 2 |
| B | 351.2 | 2.9 | 246.9 | 4.0 | 280.2 | 7 | 169.6 | 35 | 84.4 | 28 | 39.4 | 16 |
| C | 361.5 | 5.9 | 255.8 | 7.8 | 280.4 | 7 | 164.9 | 32 | 85.5 | 30 | 38.6 | 14 |
| D | 317.3 | −7.0 | 226.2 | −4.7 | 254.0 | −3 | 159.3 | 27 | 80.8 | 22 | 40.3 | 19 |

TABLE 5

| Elongation Results | | | | | | |
|---|---|---|---|---|---|---|
| | Exposure | | | | | |
| | None | None | 100 hr | 100 hrs | 100 hrs | 100 hrs |
| | Test Temp. | | | | | |
| Alloy | Room Temp | 175° C. | 150° C. | 200° C. | 250° C. | 300° C. |
| Control | 12.2 | 20.7 | 15.0 | 21.5 | 46.5 | 48.5 |
| A | 12.4 | 19.0 | 14.0 | 19.0 | 31.5 | 66.0 |
| B | 12.2 | 19.0 | 17.0 | 24.0 | 33.5 | 62.0 |
| C | 12.0 | 20.0 | 16.0 | 19.5 | 35.0 | 66.0 |
| D | 13.0 | 23.0 | 18.0 | 24.5 | 46.0 | 66.3 |

The trends in yield strength were similar for room temperature testing and testing at 175° C. and also after 100 hours exposure at 150° C., although the overall strength level was reduced by ~30% for each alloy at 175° C. as compared to room temperature. The variants A, B, and C exhibited similar strength levels and were stronger than the control, which in turn was stronger than variant D, for the testing at room temperature and at 175° C., and also for the testing after 100 hours exposure at 150° C. The additions of Mg, Si and Cu to the control alloy (i.e., Alloy A) gave significant strengthening, while it appeared that increased Mn and Fe contents (i.e., Alloys B and C) provided smaller contribution to strength increases under these conditions. This indicates that under these conditions, the dominant strengthening mechanism is due to precipitation hardening. The excess Mg in composition D actually resulted in lower strength than the control alloy under these conditions, due to the reduced amount of MgSi precipitate as shown in Table 1.

After exposure and testing after 100 hours at 200° C. and 250° C., all the experimental variants A-D gave significant (at least 30%) improvements in yield strength compared to the control alloy. After 100 hours at 250° C., the strength ranking of the alloys was A>B>C>D>Control. This indicates that precipitation hardening due to increased MgSi precipitates (e.g., $Mg_2Si$) still provides a strength contribution for this temperature and exposure time, although increased Fe and Mn contents along with excess magnesium also make a contribution to strength in variants B-D.

Figure 5:
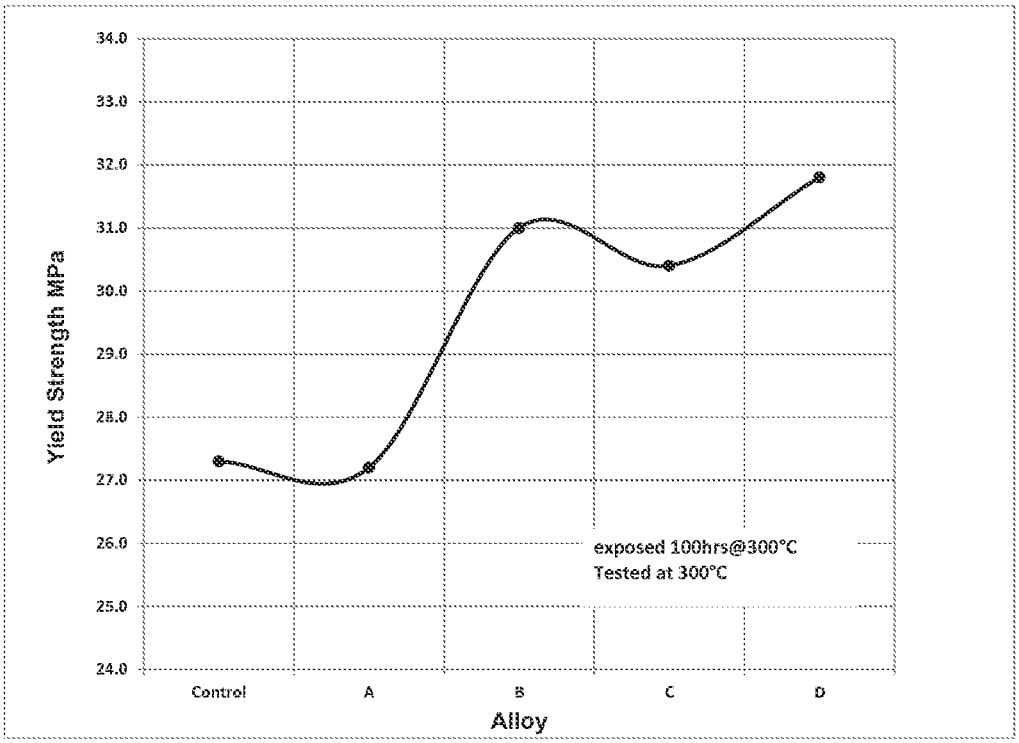
FIG. 5 is a graphical illustration of yield strength of various alloys tested at 300° C., in connection with the Example below.

For these tests, exposures were limited to 100 hours to produce test results in practical experimental times. It is known that the strength of typical 6XXX type alloys exposed at 250° C. typically continues to deteriorate up to 10,000 hours exposure (Kaufman, Properties of Aluminum Alloys, ASM International), due to coarsening of Mg—Si precipitate phases, until a plateau is reached. However, at temperatures close to 300°, the tensile properties tend to plateau after ~100 hours, as coarsening and dissolution of Mg—Si precipitate phases occurs more rapidly. Consequently, it is contemplated that the results after exposure at 300° C. in the current test program give a better indication of the ability of the alloy variants to maintain strength for long term (years) exposure at elevated temperatures (for example >200° C.). As shown in FIG. 5, after 100 hours at 300° C., the alloys B-D containing increased Fe and Mn additions all exhibited significant strength increases compared to the control. In contrast, alloy A, with the increased Mg2Si content, gave no improvement over the control. Overall, alloy D, with the highest excess Mg content, gave the highest strength after exposure at elevated temperature. It is noted that the trend for elevated temperature yield strength illustrated in FIG. 5 is almost identical to the effect of alloy type on extrusion breakthrough pressure illustrated in FIG. 1. The latter is effectively a measure of flow stress at the extrusion temperature 500° C., and indicates the strengthening mechanisms associated with increased Fe and Mn and excess Mg are also operative at that temperature.

The results for ultimate tensile strength reflected the yield strength results discussed above. The Alloys A-D mostly produced similar elongation results to the control alloy at the lower testing temperatures (up to 250° C.). However, after exposure at 300° C., all the experimental alloys gave improved ductility compared to the control.

In view of the results above, it is shown that alloys according to certain embodiments including increased levels of Mg, Si, and Cu within the ranges described herein (e.g., Alloys A-C) produce increased strength at lower temperature levels and intermediate temperature levels (e.g., 175° C.), and also after prolonged exposure at intermediate temperature levels (e.g., 130-150° C.). It is also shown that alloys according to certain embodiments having increased Mn and Fe contents within the ranges described herein (e.g., Alloys B-D) produce increased strength after prolonged exposure at intermediate temperature levels (e.g., 130-150° C.) and higher temperature levels (e.g., 250° C.), and that this strength increase is possible even without elevated Si levels for producing precipitation hardening (e.g., Alloy D), particularly at higher temperature levels. It is further shown that alloys according to certain embodiments having excess Mg contents as described herein (e.g., Alloys B-D) produce increased strength after prolonged exposure at intermediate temperature levels (e.g., 130° C.) and higher temperature levels (e.g., 250° C.), and that increased excess Mg levels (e.g., Alloy D) produces still greater increased strength after prolonged exposure at higher temperature levels (e.g., 250° C.). It is contemplated that such excess Mg levels may provide increased strength for prolonged exposure at temperature levels of over 150° C. It is also contemplated that such excess Mg levels may provide increased strength at temperature levels of up to 300° C., or possibly higher.

The embodiments described herein can provide advantages over existing alloys, composites, extrusions, and processes, including advantages over typical 6XXX alloys and alloys used in the production of neutron shielding materials. For example, the alloy described herein exhibits superior strength and tensile properties at elevated temperatures, and particularly when held at elevated temperatures for extended periods of time. This provides advantages for use in high-temperature applications, where increased high-temperature strength over a long-term period is desirable to reduce the risk of product failure. This high-temperature strength is useful, for example, in producing neutron shielding materials, which may be subjected to elevated temperature (e.g., 250° C.) for extended periods of time (e.g., 40 years). Composites including boron carbide filler materials are particularly useful for neutron shielding applications. The increased mechanical properties at elevated temperatures achieved by the alloy may be desirable for other high-temperature applications as well, and such applications may be recognizable to those skilled in the art. For example, the alloy may be utilized alone as a high-temperature structural alloy. As another example, the alloy may be used as a matrix for a different composite material, such as a different high-temperature composite material. Further, the alloy and resultant composites may be suitable for extrusion. Still further benefits and advantages are recognizable to those skilled in the art.

While the invention has been described with respect to specific examples including presently preferred modes of carrying out the invention, those skilled in the art will appreciate that there are numerous variations and permutations of the above described systems and methods. It is understood that the alloys described herein may consist of or consist essentially of the disclosed components. Thus, the spirit and scope of the invention should be construed broadly as set forth in the appended claims. All compositions herein are expressed in weight percent, unless otherwise noted.

What is claimed is:

1. A composite material comprising:

a matrix of an aluminum alloy consisting essentially of, in weight percent:

| | |
|---|---|
| Si | 0.50-1.30 |
| Fe | 0.2-0.60 |
| Cu | 0.15 max |
| Mn | 0.5-0.90 |
| Mg | 0.6-1.0 |
| Cr | 0.20 max |

Ti>0, the balance being aluminum and unavoidable impurities, wherein the alloy has excess magnesium over an amount that can be occupied by Mg—Si precipitates, wherein the excess magnesium is calculated using:

$$\text{Excess Mg}=\text{Mg}-(\text{Si}-(\text{Mn}+\text{Fe}+\text{Cr})/3)/1.16$$

where the excess magnesium is expressed as Excess Mg, and all values are expressed in weight percent; and particles of a boron carbide filler material dispersed within the matrix, wherein the boron carbide filler material has a volume fraction of 4-20% in the composite material, wherein the particles include a reaction product comprising titanium-containing intermetallic compound coating at least a portion of a surface thereof, and wherein the matrix of the aluminum alloy comprises Al—Fe—Mn—Si intermetallic phases dispersed therein, and wherein the matrix is formed from a molten aluminum alloy having a Ti content of at least 0.2 wt % prior to the formation of said reaction product.

2. The composite material of claim 1, wherein the filler material has greater neutron absorption and radiation shielding capabilities than the matrix.

3. The composite material of claim 1, wherein the filler material has a higher hardness and a higher melting point than the aluminum alloy of the matrix.

4. The composite material of claim 1, wherein the Cu content of the alloy is up to 0.1 max wt. %.

5. The composite material of claim 1, wherein the Si content of the alloy is 0.70-1.30 weight percent.

6. The composite material of claim 1, wherein the Mg content of the alloy is 0.60-0.80 weight percent.

7. The composite material of claim 1, wherein the alloy has at least 0.25 wt. % excess magnesium.

8. The composite material of claim 1, wherein the matrix is formed from a molten aluminum alloy having a Ti content of 0.2-2 wt. % prior to formation of the reaction product.

9. A method comprising:

preparing a molten aluminum alloy consisting essentially of, in weight percent:

| | |
|---|---|
| Si | 0.50-1.30 |
| Fe | 0.2-0.60 |
| Cu | 0.15 max |
| Mn | 0.5-0.90 |
| Mg | 0.6-1.0 |
| Cr | 0.20 max |

the balance being aluminum and unavoidable impurities, wherein the alloy has excess magnesium over an amount that can be occupied by Mg—Si precipitates, wherein the excess magnesium is calculated using:

$$\text{Excess Mg}=\text{Mg}-(\text{Si}-(\text{Mn}+\text{Fe}+\text{Cr})/3)/1.16$$

where the excess magnesium is expressed as Excess Mg, and all values are expressed in weight percent;

adding particles of a boron carbide filler material to the molten aluminum alloy to form a molten mixture having the filler material dispersed throughout the alloy; and casting the molten mixture to form a composite material having the aluminum alloy as a matrix and the filler material dispersed throughout the matrix, wherein the boron carbide filler material has a volume fraction of 4-20% in the composite material, wherein the particles include a reaction product comprising titanium-containing intermetallic compound coating at least a portion of a surface thereof, and wherein the matrix of the aluminum alloy comprises Al—Fe—Mn—Si intermetallic phases dispersed therein.

10. The method of claim 9, further comprising extruding the composite material to form an extruded product.

11. The method of claim 9, further comprising:

stirring the molten mixture to wet the aluminum alloy to the particles of the boron carbide filler material and to distribute the particles throughout a volume of the molten mixture, prior to casting.

* * * * *